US007637489B2

(12) United States Patent
Brünner et al.

(10) Patent No.: US 7,637,489 B2
(45) Date of Patent: Dec. 29, 2009

(54) STITCHING APPARATUS AND GATHERING AND STITCHING MACHINE HAVING THE STITCHING APPARATUS

(75) Inventors: Torsten Brünner, Borsdorf (DE); Siegmar Tischer, Borsdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 387 days.

(21) Appl. No.: 11/523,369

(22) Filed: Sep. 19, 2006

(65) Prior Publication Data

US 2007/0069443 A1 Mar. 29, 2007

Related U.S. Application Data

(60) Provisional application No. 60/721,308, filed on Sep. 28, 2005.

(30) Foreign Application Priority Data

Sep. 29, 2005 (DE) ..... 10 2005 046 683

(51) Int. Cl.
*B65H 37/04* (2006.01)

(52) U.S. Cl. ..... 270/52.18; 270/52.14; 270/52.16; 270/52.26; 270/52.29; 270/58.08

(58) Field of Classification Search ..... 270/52.14, 270/52.16, 52.18, 52.26, 52.29, 58.08
See application file for complete search history.

(56) References Cited

U.S. PATENT DOCUMENTS

| | | | | |
|---|---|---|---|---|
| 1,336,251 | A * | 4/1920 | Maynard | 227/103 |
| 3,502,256 | A | 3/1970 | Boulay et al. | |
| 3,899,165 | A * | 8/1975 | Abram et al. | 270/52.03 |
| 4,537,342 | A | 8/1985 | McCain et al. | |
| 4,971,302 | A | 11/1990 | Morii et al. | |
| 5,938,388 | A * | 8/1999 | Bloser et al. | 412/1 |
| 6,866,257 | B2 | 3/2005 | Brünner et al. | |
| 7,032,898 | B2 | 4/2006 | Silberbauer | |
| 2002/0043755 | A1 * | 4/2002 | Machon et al. | 270/58.09 |

FOREIGN PATENT DOCUMENTS

| | | |
|---|---|---|
| DE | 1 586 318 | 4/1970 |
| DE | 36 14 320 A1 | 10/1987 |
| DE | 39 13 600 A1 | 11/1989 |
| EP | 0 916 514 A1 | 5/1999 |
| EP | 1 273 460 A2 | 1/2003 |
| EP | 1 331 105 A2 | 7/2003 |
| EP | 1 419 898 A1 | 5/2004 |
| GB | 841162 | 7/1960 |

* cited by examiner

*Primary Examiner*—Gene Crawford
*Assistant Examiner*—Leslie A Nicholson, III
(74) *Attorney, Agent, or Firm*—Laurence A. Greenberg; Werner H. Stemer; Ralph E. Locher

(57) ABSTRACT

A stitching apparatus for manufacturing printed products, in particular in a gathering and stitching machine, includes a stitching carriage, at least one stitching head for shaping and driving a staple into a stack of signatures, and at least one clinch box for closing the staple driven through the signatures. An actuating device vertically displaces the stitching head for adaptation of the stitching apparatus to a thickness of the stack of signatures. A gathering and stitching machine having a stitching apparatus is also provided.

11 Claims, 2 Drawing Sheets

STITCHING APPARATUS AND GATHERING AND STITCHING MACHINE HAVING THE STITCHING APPARATUS

CROSS-REFERENCE TO RELATED APPLICATION

This application claims the priority, under 35 U.S.C. §119 (e), of Provisional Patent Application No. 60/721,308, filed Sep. 28, 2005; this application also claims the priority, under 35 U.S.C. §119, of German Patent Application DE 10 2005 046 683.4, filed Sep. 29, 2005; the prior applications are herewith incorporated by reference in their entirety.

BACKGROUND OF THE INVENTION

Field of the Invention

The invention relates to a stitching, stapling or binding apparatus for manufacturing printed products, in particular in a gathering and stitching machine. The stitching apparatus includes a stitching carriage, at least one stitching head for shaping and driving a staple into a stack of signatures and a clinch box for closing the staple driven through the signatures. The invention also relates to a gathering and stitching machine having the stitching apparatus.

Apparatuses for stitching folded signatures or printed products are typically provided in what are known as gathering and stitching machines or gatherers and stitchers. Such gathering and stitching machines which separate folded printed products, deposit them on a transport device, such as a transport chain or the like, gather and collate them and then lead them to a stitching station and subsequently optionally to a further processing unit, such as an edge trimming device, a delivery or the like, are known.

For example, European Patent EP 0 916 514 B1 discloses a typical gathering and stitching machine having a front gathering chain and a rear gathering chain as a transport device. Individual folded sheets or folded signatures are separated from stacks, opened and placed onto the gathering chains by folded sheet feeders. A guide bar is disposed between the gathering chains. The upper section of the guide bar has a knife-shaped configuration and a ridge line of the guide bar fixes the transport and stitching line. Together with the guide bar, the gathering chains form a substantially roof-shaped support, astride which the folded sheets or folded signatures are transported. In order to also reliably grip the folded sheets which are deposited on the gathering chains at a high transport speed and to load them uniformly, the gathering chains or their drivers run in front of and behind the guide bar, with the result that a deposited folded sheet is gripped simultaneously on both limbs. The folded sheets which are gripped by the drivers are transported by the front and the rear gathering chains as far as a stitching station, in which folded sheets that lie on top of one another or a number of folded signatures are stitched in the fold with the aid of a staple, in particular a wire staple. Stitching heads which are disposed above the gathering chain and clinch boxes which are disposed between the gathering chains instead of the guide bar, serve that purpose. The clinch boxes bend over the free ends of the staples which are punched through the folded sheets by the stitching heads. Subsequently, the stitched folded sheets or folded signatures are transported further by at least one of the gathering chains for further processing, for example for edge trimming, or to the delivery.

The adaptability of the gathering and stitching machine and therefore of the stitching apparatus to a frequently changing product thickness as quickly as possible is becoming more and more important. That is a result of the increasing degree of individualization of printed products, what is known as "selective binding", in which different sizes and different numbers of signatures are collated depending on the recipient.

Therefore, adjustable devices for guiding gathered printed products have heretofore been used in gathering and stitching machines. In machines having continuous gathering chains, such as various conventional gathering and stitching machines of known manufacturers, in each case the height of both the front chain and the rear chain can be adjusted, in particular as a function of the product thickness. In that case, typically used guide elements can, for example, support the printed products from above with respect to a sheet metal path, but only prevent tilting or collision of the leading printed product edges or small edges which lie on the inside, for example of inserted cards, to a limited extent. As a consequence, in diverse printed products, disruptions can occur in the inlet and outlet of the stitching region by stoppages, faulty sheets or the like, so that downtimes of the gathering and stitching machine frequently result. Moreover, in continuous transport devices, in particular gathering chains, it is necessary to provide an adjustable height chain guide device. However, a deflection of the gathering chain frequently leads to increased wear or drive problems. In addition, in general, the front chain of the transport device should be removable or detachable in a simple manner from the rest of the machine, in order to ensure that the stitching region is accessible to the operator in a convenient manner if required, which is made more difficult by an adjustable height chain guide device.

An apparatus of that type is known, for example, from European Patent Application EP 1 419 898 A1, corresponding to U.S. Pat. No. 7,032,898.

A further apparatus of the generic type is known from European Patent Application EP 1 273 460 A2, corresponding to U.S. Pat. No. 6,866,257. In that case, there is also the problem of guiding the signatures on the transport path of a gathering and stitching machine in the region of the stitching station. There, the problem is solved by a guide element for supporting the number of folded signatures during transport through the inlet region and/or through the outlet region.

However, in all of the above-mentioned apparatuses from the prior art, the adaptation of the stitching apparatus to the product thickness is complicated and susceptible to faults.

SUMMARY OF THE INVENTION

It is accordingly an object of the invention to provide a stitching apparatus to be available in a gathering and stitching machine and a gathering and stitching machine having the stitching apparatus, which overcome the hereinafore-mentioned disadvantages of the heretofore-known devices of this general type, which permit simple and advantageous automatic adaptation to a product thickness and which are also less susceptible to faults.

With the foregoing and other objects in view there is provided, in accordance with the invention, a stitching apparatus for manufacturing printed products, in particular in a gathering and stitching machine. The stitching apparatus comprises a stitching carriage. At least one stitching head shapes and drives a staple into the stack of signatures. A clinch box closes the staple driven through the signatures. An actuating device vertically displaces the stitching head to adapt the stitching apparatus to a thickness of the stack of signatures.

As compared with the prior art, the invention is therefore distinguished, in particular, by the fact that the signatures are not moved vertically on the transport plane for vertical adaptation, rather the horizontal position of the signatures is maintained constantly. Instead, the level of the stitching heads is displaced as a function of the product thickness. In this way, the transport of the signatures also remains comparatively smooth in the region of the stitching heads, as a result of which the susceptibility to faults due to the high, typical operating speeds of generic gathering and stitching machines of this type is reduced. The stitching apparatus advantageously includes two or more stitching heads.

In accordance with another feature of the invention, the actuating device includes a first swinging arm for the vertical adjustment of the stitching head and a second swinging arm for controlling the movement sequences of the stitching head, in particular the shaping and driving of the staple into the stack of signatures. The first swinging arm and the second swinging arm are coupled to one another. In order to make vertical adaptation possible, firstly the vertical position of the underside of the stitching head has to be adapted to the product thickness, in order to ensure that the driving-in action also begins actually at the correct position and the staple also reaches the bending-over device in the clinch box correctly. Secondly, the control device, from which the movement sequences within the stitching head are derived, also has to be set to the changed vertical position of the stitching head. In this advantageous embodiment, this takes place in a particularly simple manner by the coupling between the two swinging arms, with the result that all of the required vertical adjustments can be carried out at the same time by a single adjusting mechanism, for instance an adjusting screw or an adjusting motor.

In accordance with a concomitant feature of the invention, the first swinging arm is mounted in the common pivot point at the other end and the second swinging arm has at least one cam roller which is guided in a curved path of a cam disc that is mounted rotatably about a pivot so that the movement sequences of the stitching head can be produced. The pivot point is situated within the pivoting region, which is produced by the curved path, of the at least one cam roller. The pivot of the cam disc and the pivot point lie on the same axis in a particularly advantageous manner.

Other features which are considered as characteristic for the invention are set forth in the appended claims.

Although the invention is illustrated and described herein as embodied in a stitching apparatus and a gathering and stitching machine having the stitching apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
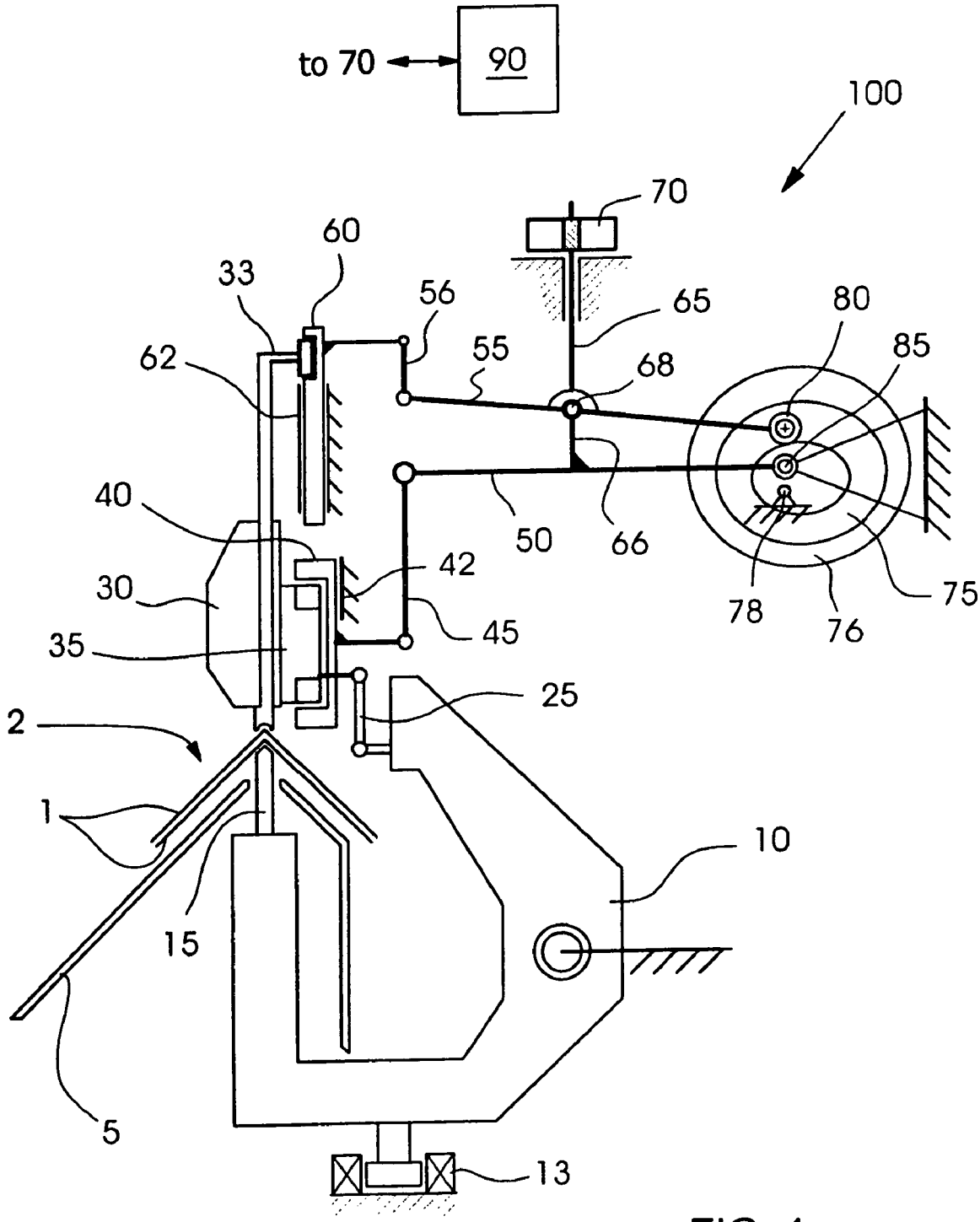
FIG. 1 is a diagrammatic, side-elevational view of a first embodiment of an apparatus according to the invention.
Figure 2:
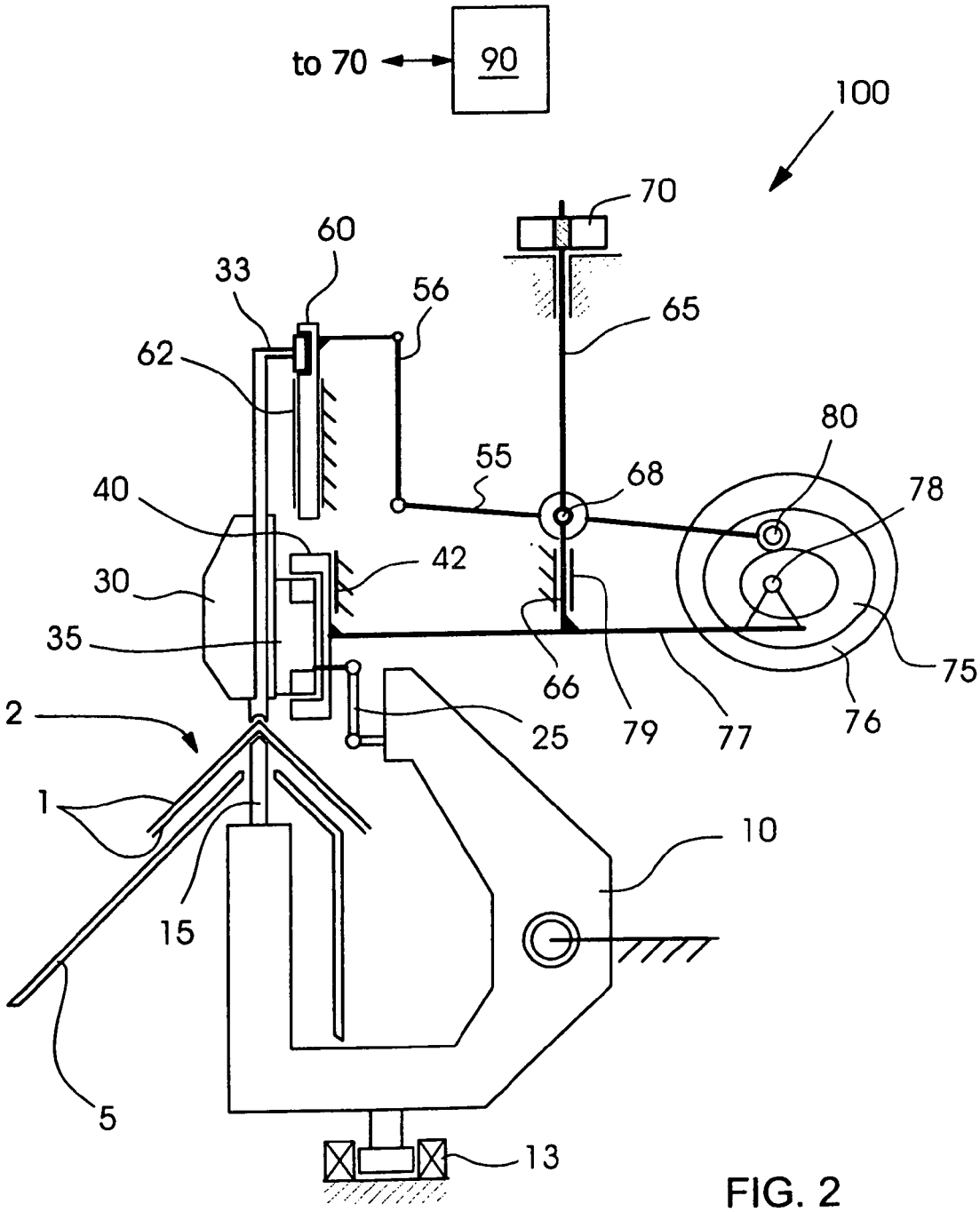
FIG. 2 is a view similar to FIG. 1 of a second embodiment of the apparatus according to the invention.

Referring now in detail to FIGS. 1 and 2 of the drawings as a whole, there are seen embodiments of a stitching apparatus 100 according to the invention which are restricted to an illustration and description of details that are important to the invention. Further elements which are required for operation of the stitching apparatus, such as a guide device, a controller, drives, a fastening device etc., which, in particular, also do not differ from the prior art or are borrowed from the latter, are not described in further detail and/or are omitted for clarity. In particular, only one slide 33 is shown for control of movement sequences in the stitching head, although a slide for driving and a slide for bending over are typically used for this purpose.

Individual signatures 1 are gathered one above another in a known manner to form saddle-shaped stacks 2 on a non-illustrated gathering chain which is, however, also known to a person skilled in the art from the above-mentioned prior art, and are transferred to the stitching apparatus 100, stitched there and subsequently trimmed at three open sides. The signature stack 2 is conveyed through the stitching apparatus 100 on a stitching carriage 10. The signature stacks 2 are supported laterally by guide plates 5. At least one clinch box 15 is disposed below the signature stack 2. The clinch box 15 is connected fixedly to the stitching carriage 10 and includes a bending-over device which bends together a staple that is driven through the signature stack 2 by at least one stitching head 30 and therefore produces a printed product which is almost finished. The number of stitching heads 30 and therefore also the number of clinch boxes 15 depends typically on the performance range of the gathering and stitching machine, and two or more stitching heads 30 are therefore customary.

The stitching carriage 10 is mounted movably on one side in a stitching carriage guide 13 for movement in a transport direction of the signatures 1 and is driven by an individual drive or a common drive, for instance by a vertical shaft. On the other side, the stitching carriage 10 is connected through a stitching carriage coupler 25 to a stitching head holding bar 35 in such a way that movement of the stitching carriage in the transport direction of the signatures 1 is transmitted to the stitching head holding bar 35. The at least one stitching head 30 is disposed on the stitching head holding bar 35. In this way, the at least one stitching head 30 is also moved in the transport direction of the signature stack 2 in such a way that there is no relative speed in the transport direction between the stitching head 30 and the signature stack 2 when the staple is driven into the signature stack 2.

To this end, the stitching head holding bar 35 is guided in a stitching head holding bar horizontal guide 40. The stitching head holding bar horizontal guide 40, for its part, is guided in a stitching head holding bar vertical guide 42, with the result that the stitching head holding bar horizontal guide 40 together with the at least one stitching head 30 can be displaced vertically relative to the at least one clinch box 15 and therefore also relative to the underside of the signature stack 2, in order for it to be possible to set it to different product thicknesses of the signature stack 2. In contrast, the clinch box 15 remains on the same plane during the entire movement sequence.

The movement sequences within the stitching head 30, in particular the shaping and the driving of the staple, but also the wire advance etc., are derived at least from the slide 33 which is part of the stitching head 30 and which for its part is driven and controlled by a guide on a stitching head drive bar 60. The stitching head drive bar 60 is, for its part, guided in a stitching head drive bar vertical guide 62, with the result that the stitching head drive bar 60 together with the slide 33 can be displaced vertically relative to the at least one clinch box 15 and therefore also relative to the underside of the signature stack 2. However, the stitching head drive bar 60 is also moved up and down in normal operation, in order to move the at least one slide 33 up and down in the stitching head. The vertical displacement of the stitching head drive bar 60 takes place through a second coupler 56 which is connected on one side in an articulated manner to the stitching head drive bar 60 and is connected on the other side in an articulated manner to a second swinging arm 55. The second swinging arm 55 is pivoted about a fulcrum 68 and, at the other end, has a cam roller 80 which rolls on a curved path 75 of a cam disc 76. In this case, the cam disc 76 rotates about a pivot 78 and is otherwise fixed to the unit. The remaining movement sequences in the stitching head 30 are derived in turn from this movement of the stitching head drive bar 60 through the slide movement of the slide 33.

The height is then adjusted due to the change in the product thickness, as follows: The stitching head holding bar vertical guide 42 is connected in an articulated manner to a first coupler 45 which, for its part, is connected to a first swinging arm 50 that is mounted pivotably at the other end on a pivot point 85 which is fixed to the unit. In this case, the pivot point 85 is situated in the pivoting region of the cam roller 80 of the second swinging arm 55. The pivot point 85 of the first swinging arm 50 and the pivot 78 of the cam disc 76 lie particularly advantageously on the same axis.

The first swinging arm 50 has a swinging arm coupler 66 which is rigidly connected, for example at right angles, to the first swinging arm, for example on one side, and is connected in an articulated manner on the other side to the second swinging arm 55 at its fulcrum 68. This fulcrum can be displaced vertically by a spindle 65, for instance by a spindle drive, for example a handwheel. In one preferred exemplary embodiment, the swinging arm coupler 66 has a zero length, with the result that the swinging arm 50 is therefore coupled to the swinging arm 55 jointly at the fulcrum 68.

As an alternative, it is conceivable that the vertical displacement of the fulcrum 68 is brought about by a drive 70, for instance a linear motor, or that this drive is also connected to the two coupled swinging arms 50, 55 at another point. Clearly, the spindle 65 can also be disposed in an installation position which deviates from the vertical, if the remaining actuating device is adapted accordingly. A controller 90 can also advantageously be provided, which drives the drive 70 automatically so as to carry out the desired vertical adjustment of the stitching head 30 and the stitching head drive bar 60.

If, for example, the spindle 65 is then actuated in such a way that the fulcrum 68 is raised, the first swinging arm 50 and also, as a result of the coupling 66 between the first swinging arm 50 and the second swinging arm 55, the second swinging arm 55, pivot about the common pivot point 85. As a result, the desired vertical adjustment can take place quickly and in a simple manner, without it being necessary to carry out further setting work.

FIG. 2 shows a further embodiment of the apparatus according to the invention which illustrates a special case of the first embodiment of FIG. 1. In this case, the swinging arm 50 and the first coupler 45 are configured in one piece and are guided in a vertical guide 79. The stitching head holding bar horizontal guide 40 and the pivot 78 of the cam disc 76 are then displaced together at the same time during the vertical displacement of the slide 77 by a knurled screw 70, and also, of course, the second swinging arm 55 with the parts which are connected to it, as in the first exemplary embodiment. However, the displacement then no longer takes place on a circular path with an infinitely large radius, that is to say a straight path. As a result, the influence on the displacement of the curved path during thickness adjustment is even smaller.

We claim:

1. A stitching apparatus for manufacturing printed products, the stitching apparatus comprising:

a stitching carriage for conveying a stack of signatures;

a stitching head holding bar;

a stitching head drive bar being movable up and down;

at least one stitching head being disposed on said stitching head holding bar for shaping and driving a staple into the stack of signatures;

a clinch box for closing the staple driven through the signatures;

an actuating device for vertical displacement of said stitching head to adapt the stitching apparatus to a thickness of the stack of signatures, said actuating device including a first swinging arm for vertical adjustment of said stitching head and a second swinging arm for controlling movement sequences of said stitching head, said first swinging arm and said second swinging arm being coupled to one another;

said first swinging arm being mounted on said stitching head holding bar on one side for vertical adjustment of said stitching head; and said second swinging arm swinging about a fulcrum and being mounted on said up and down movable stitching head drive bar on one side, for controlling movement sequences of said stitching head.

2. The stitching apparatus according to claim 1, wherein said clinch box and said stitching carriage are connected fixedly to one another.

3. The stitching apparatus according to claim 1, wherein said movement sequences of said stitching head are shaping and driving the staple into the stack of signatures.

4. The stitching apparatus according to claim 1, wherein said movement sequences of said stitching head include shaping and driving the staple into the stack of signatures.

5. The stitching apparatus according to claim 1, wherein said first swinging arm and said second swinging arm are pivotable about a common pivot point.

6. The stitching apparatus according to claim 5, wherein said first swinging arm has an end mounted at said common pivot point and said second swinging arm has at least one cam roller guided in a curved path of a cam disc mounted rotatably about a pivot, for producing said movement sequences of said stitching head, and said pivot point is situated within a pivoting region produced by said curved path of said at least one cam roller.

7. The stitching apparatus according to claim 6, wherein said pivot of said cam disc and said pivot point lie on one axis.

8. The stitching apparatus according to claim 1, wherein said first swinging arm and said second swinging arm are displaceable vertically.

9. The stitching apparatus according to claim 1, wherein said second swinging arm swings about a fulcrum, and an adjusting device simultaneously adjusts a position of said first swinging arm and said fulcrum of said second swinging arm.

10. The stitching apparatus according to claim 9, which further comprises a controller automatically adjusting said first swinging arm and said second swinging arm through said adjusting device, as a function of a product thickness of the stack of signatures.

11. A gathering and stitching machine, comprising a stitching apparatus for manufacturing printed products, said stitching apparatus including:

a stitching carriage for conveying a stack of signatures;

a stitching head holding bar;

a stitching head drive bar being movable up and down;

at least one stitching head being disposed on said stitching head holding bar for shaping and driving a staple into the stack of signatures;

a clinch box for closing the staple driven through the signatures; an actuating device for vertical displacement of said stitching head to adapt said stitching apparatus to a thickness of the stack of signatures, said actuating device including a first swinging arm for vertical adjustment of said stitching head and a second swinging arm for controlling movement sequences of said stitching head, said first swinging arm and said second swinging arm being coupled to one another;

said first swinging arm being mounted on said stitching head holding bar on one side for vertical adjustment of said stitching head; and said second swinging arm swinging about a fulcrum and being mounted on said up and down movable stitching head drive bar on one side, for controlling movement sequences of said stitching head.

* * * * *